United States Patent [19]

Smith et al.

[11] Patent Number: 5,029,827

[45] Date of Patent: Jul. 9, 1991

[54] VARIABLE BELT CRADLE ROLL SUPPORT FOR CLOTH SPREADING MACHINE

[75] Inventors: Hoyt L. Smith; Michael D. Russell, both of Nashville, Tenn.

[73] Assignee: Saber Industries, Inc., Nashville, Tenn.

[21] Appl. No.: 407,344

[22] Filed: Sep. 14, 1989

[51] Int. Cl.[5] ..... B65H 29/46

[52] U.S. Cl. ..... 270/31; 270/30

[58] Field of Search ..... 270/30, 31; 242/67.2, 242/67.3, 86.5

[56] References Cited

U.S. PATENT DOCUMENTS 3,782,649 1/1974 Frederick ..... 270/31

4,589,644 5/1986 Gratsch ..... 270/31

4,676,494 6/1987 Smith ..... 270/30

*Primary Examiner*—Edward K. Look

*Assistant Examiner*—Therese M. Newholm

*Attorney, Agent, or Firm*—Harrington A. Lackey

[57] ABSTRACT

A belt cradle cloth roll support apparatus for a cloth spreading machine including a pair of first and second endless belt members defining a V-shaped trough and trained about a plurality of rollers, including an adjustment mechanism for moving one of the belt members toward and away from the other belt member in order to decrease the angle of the V-shaped trough in order to better contain and control smaller diameter cloth rolls which have diminished in size as they are unwound while supported on the V-shaped belt cradle.

7 Claims, 4 Drawing Sheets

VARIABLE BELT CRADLE ROLL SUPPORT FOR CLOTH SPREADING MACHINE

BACKGROUND OF THE INVENTION

This invention relates to a cloth feeding apparatus for a cloth spreading machine, and more particularly to a belt cradle roll support for a cloth spreading machine.

Various types of cloth feed apparatus have been utilized in the past for supporting and feeding a web of cloth from a cloth roll on a cloth spreading machine, in which the cloth roll is supported upon a cradle of cloth rollers or cloth feed belt, such as illustrated in the following U.S. patents:

| | | |
|---|---|---|
| 1,265,452 | Isaacs | May 7, 1918 |
| 2,118,556 | Haberstump et al | May 24, 1938 |
| 2,276,479 | Gilbert | Mar. 17, 1942 |
| 2,291,351 | Scoles et al | July 28, 1942 |
| 3,394,897 | Martin Sr. | July 30, 1968 |
| 3,412,950 | Martin Sr. | Nov. 26, 1968 |
| 3,468,529 | Martin Sr. et al | Sept. 23, 1969 |
| 3,591,166 | Ebisu | July 6, 1971 |
| 3,627,301 | Benson et al | Dec. 14, 1971 |
| 3,782,649 | Frederick et al | Jan. 1, 1974 |
| 4,519,595 | Adachi | May 28, 1985 |
| 4,676,494 | Smith et al | June 30, 1987 |

Although not related to cloth spreading machines, U.S. Pat. No. 2,122,674, issued to Wardle on Jul. 5, 1938, discloses a pair of pivotal roller-supporting cradle adapted to support a large coil of metal strip or metal sheet material.

The above Isaacs patent discloses various types of cloth roll supporting cradle rollers. FIG. 3 of Isaacs discloses a pair of frames supporting a plurality of parallel transverse rollers in a V-shape and adapted to be pivotally adjusted about a common pivot axis, and which may be lowered to a horizontal position in order to load and unload the cloth roll.

Harberstump et al, Gilbert and Smith et al disclose V-shaped belt cradles for supporting cloth rolls in a cloth spreading machine.

The prior Smith et al U.S. Pat. No. 4,676,494 discloses a V-shaped belt-types cradle support for a cloth roll including a pair of intermediate cloth support rolls, all in relatively fixed positions relative to each other.

It has been found that a belt-type cradle cloth roll support, as disclosed in the Smith et al patent, operates quite satisfactorily as long as the cloth roll is large, and in its initial unwinding stages. However, as the web is unwound from the cloth roll, the roll substantially diminishes in diameter until it becomes quite small. As the roll becomes smaller, it also becomes lighter in weight. When a small roll is supported upon a relatively shallow V-shaped belt trough, as illustrated in FIG. 2 of the Smith et al U.S. Pat. No. 4,676,494, the frictional forces between the cloth roll and the moving feed belts is reduced, and the small roll tends to become displaced in the feed direction, and tends to roll to and fro in the feed direction upon the feed belts. Such movement of the cloth roll creates variations in the tension in the cloth web as it is being spread, and consequently produces excessive tension, slack, wrinkling and/or disalignment of the fabric webs. The wrinkling and disalignment is especially emphasized in thin fabrics, as well as stretchy fabrics, such as knitwear.

SUMMARY OF THE INVENTION

It is therefore an object of this invention to provide a cloth feed and support apparatus for a cloth spreading machine incorporating a cradle having a pair of endless belt members arranged in a V-shaped trough in which the angle between the belt members may be varied by moving at least the lower portion of one of the belt members toward and away from the other belt member for better receiving and controlling unwinding cloth rolls of diminishing size.

Another object of this invention is to provide a belt cradle cloth roll support incorporating a pair of endless belt members declining toward each other and supported by a plurality of transverse belt rollers, in which the intermediate belt roller of one of the belt members is adapted to be moved away from the plane of the belt member in order to pivot or swing the lower portion of the belt member toward the other belt member to decrease the angle between the two belt members.

Preferably, the belt cradle roll support made in accordance with this invention incorporates at least three sets of generally parallel belt rollers within one of the endless belt members, and including an upper belt roller, and a lower belt roller, about which the endless belt is trained, and an intermediate belt roller capable of being moved toward and away from the plane containing the rotary axes of the upper and lower belt rollers. In order to compensate for the inextensible endless belt, as the intermediate belt roller is moved, the upper roller is mounted for simultaneous movement with the movement of the intermediate roller in order to maintain the same amount of tension in the moving belt member.

It is also within the scope of this invention to provide a belt cradle roll support having front and rear feed belt members, in which at least the lower portion of the front belt member is adapted to be moved toward and away from the rear belt member, and the rear belt member is also adapted to be raised and lowered not only to improve the angle of the V-shaped cradle trough between the belt members, but also to facilitate loading and unloading the cloth roll upon the cradle support.

DESCRIPTION OF THE PREFERRED EMBODIMENT

Figure 1:
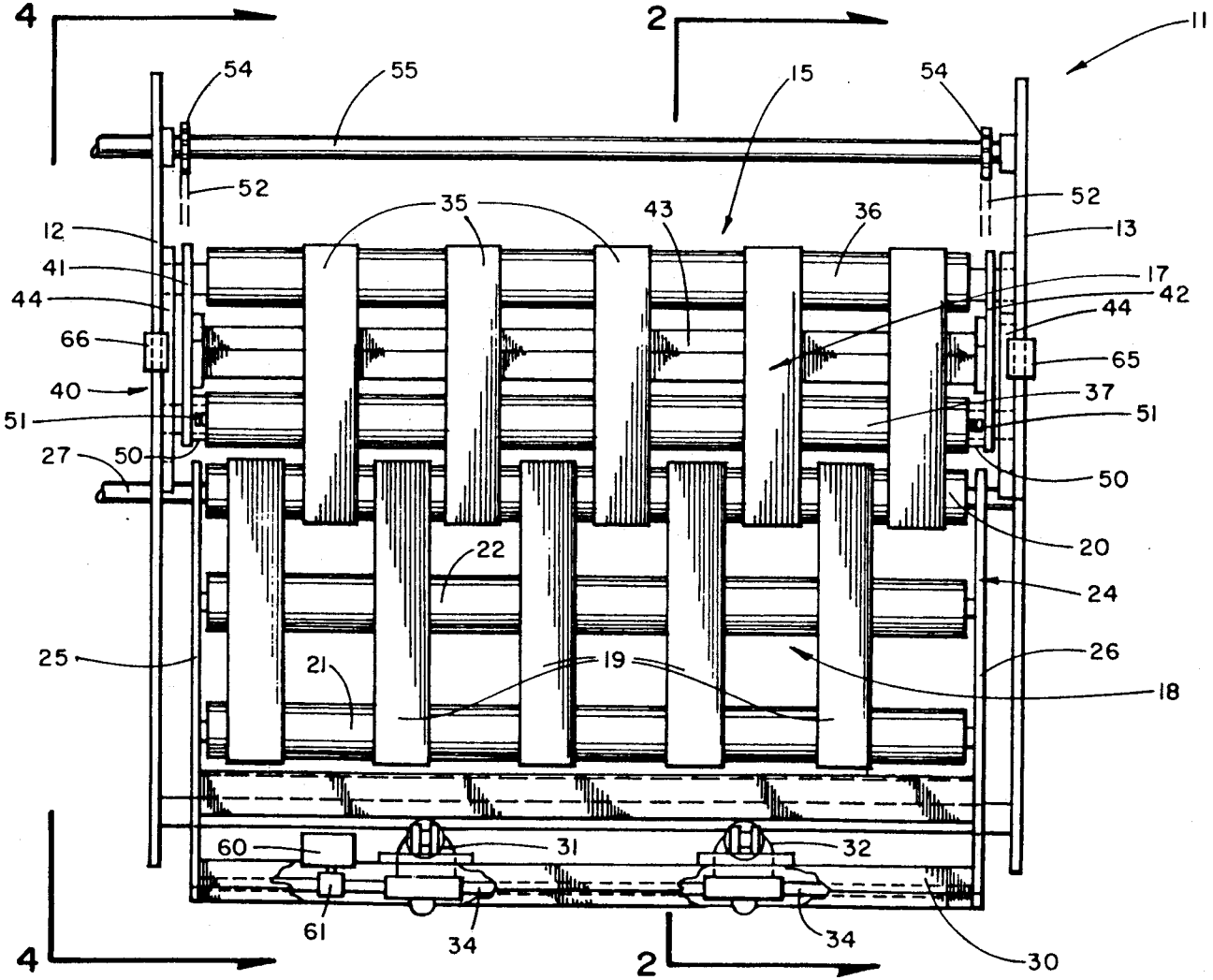
FIG. 1 is a top plan view of the belt cradle roll support made in accordance with this invention, with portions broken away.
Figure 2:
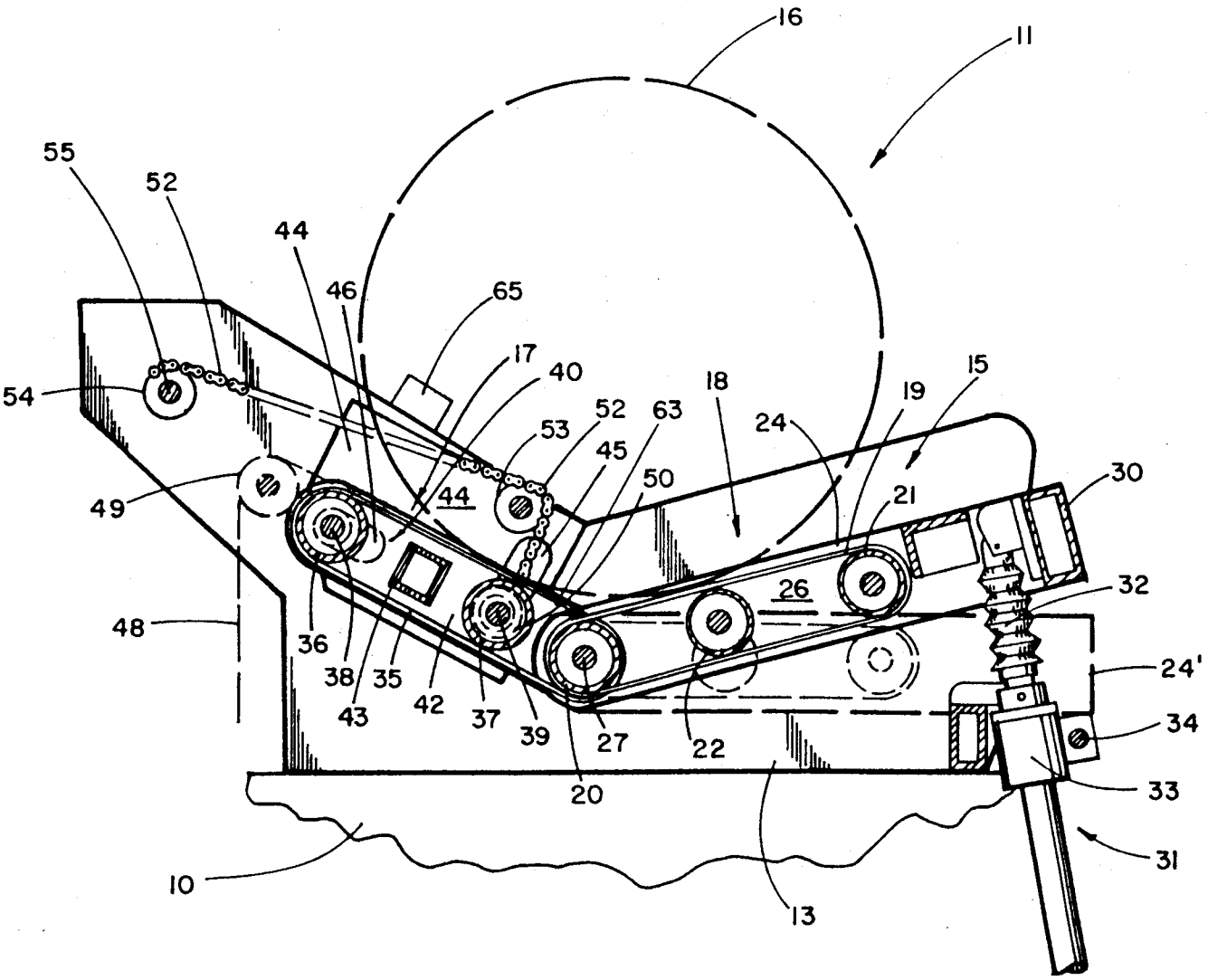
FIG. 2 is a sectional elevation of the roll support disclosed in FIG. 1, taken along the line 2—2 of FIG. 1, with a cloth roll shown in operative position, and the rear feed belt member shown in loading position in phantom.
Figure 3:
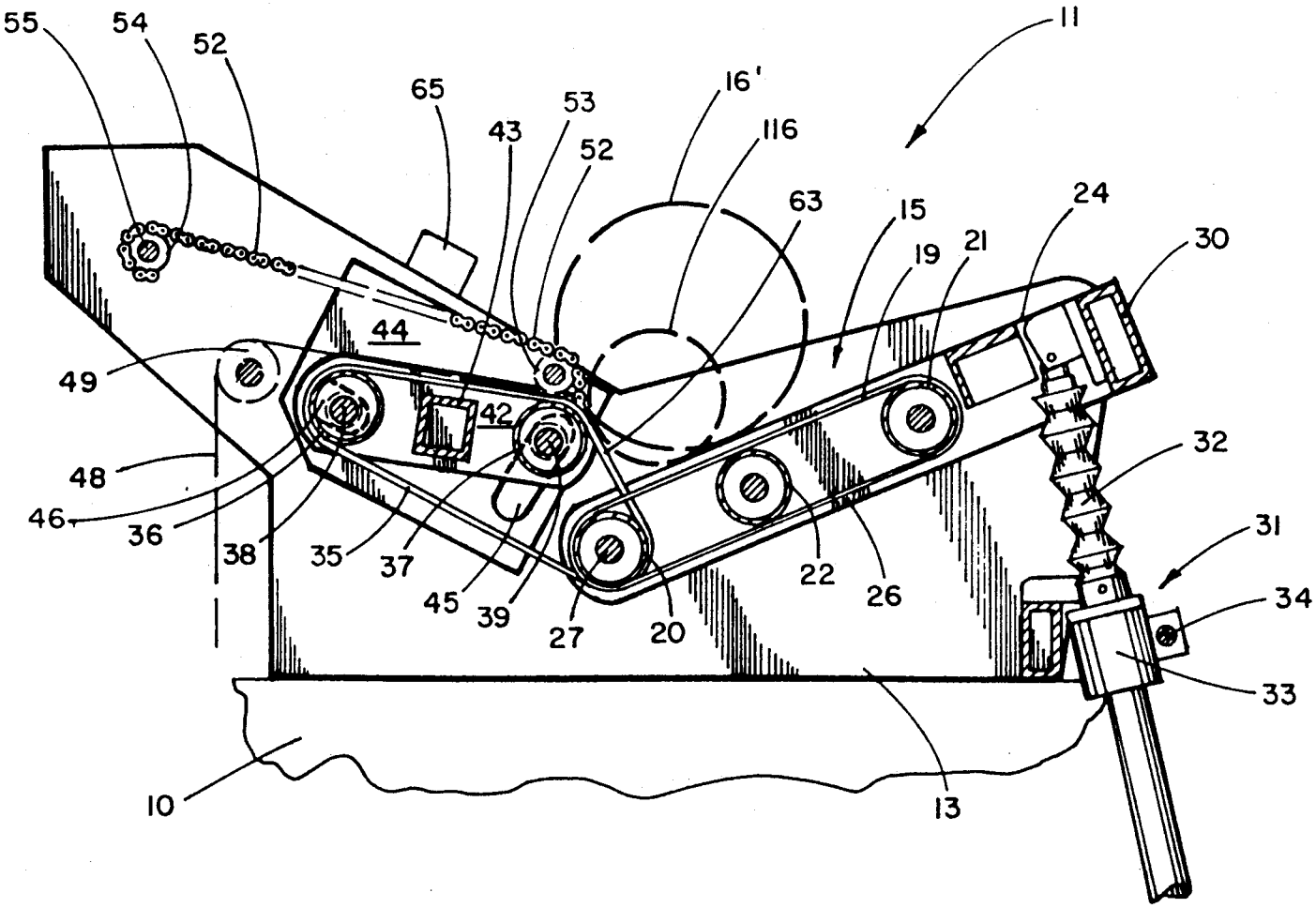
FIG. 3 is a sectional elevation similar to FIG. 2, illustrating the belt cradle roll support in another position for supporting a cloth roll of diminished diameter.

Referring now to the drawings in more detail, FIGS. 1-3 disclose a cloth spreading machine 10 upon which is mounted a cloth roll support frame 11 having a pair of parallel sidewalls or plates 12 and 13, secured together by spacer rods, not shown. Mounted within the support frame 11 is a cradle 15 for supporting a cloth roll 16.

The cradle 15 includes a pair of feed belt members 17 and 18, the front feed belt member 17 and the rear feed belt member 18 normally disposed in a substantially V-shaped trough or cradle 15.

The rear feed belt member 18 includes a plurality of transversely spaced endless feed belts 19 trained about a lower elongated transverse feed roller 20, a rear upper belt roller 21, and a rear intermediate belt roller 22. Each of the rollers 20, 21, and 22 are journaled at their opposite ends in a rear roller frame 24 having opposite side walls or side frame bars 25 and 26, respectively.

Figure 4:
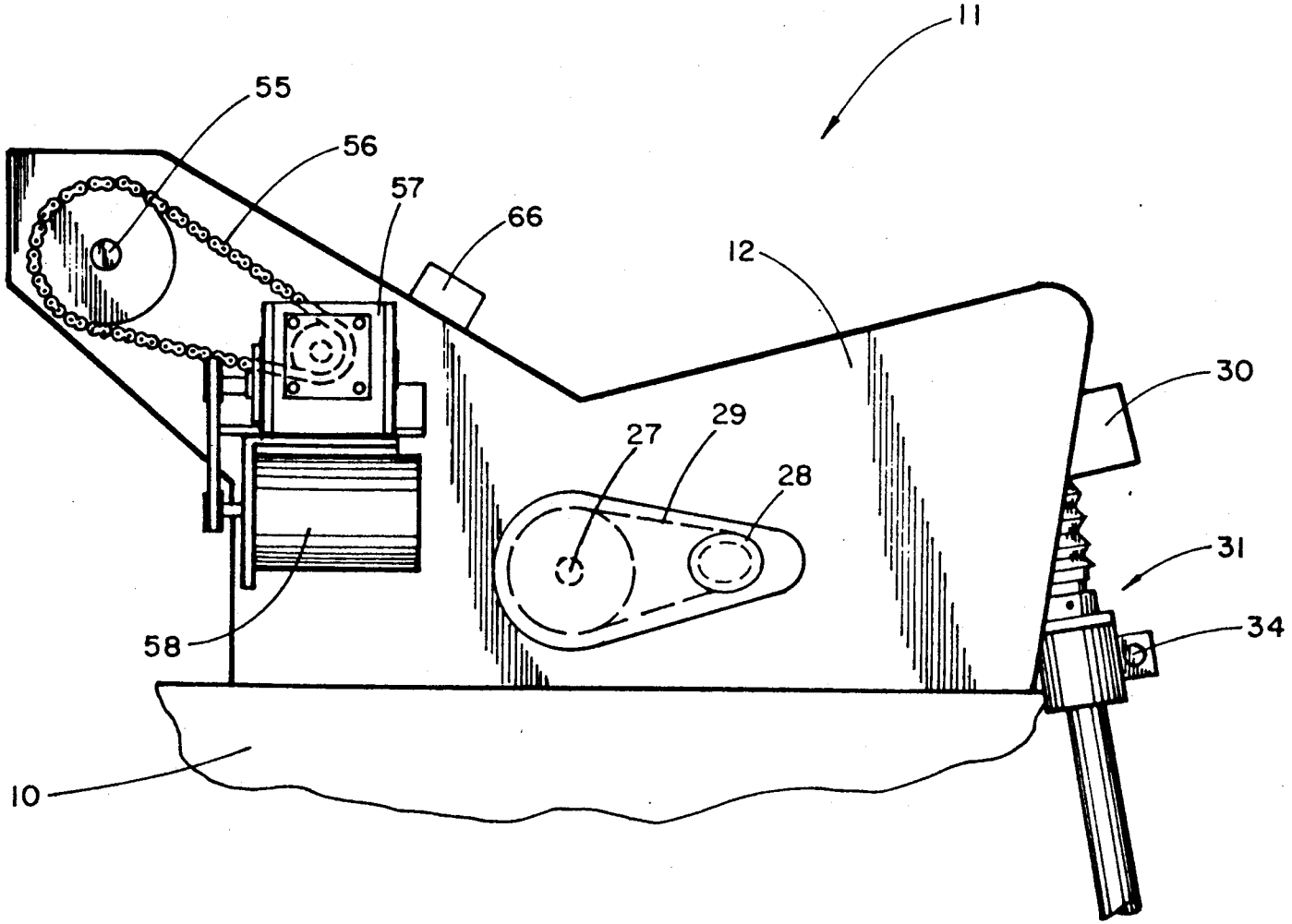
FIG. 4 is a side elevational view taken along the line 4—4 of FIG. 1, illustrating the drive mechanisms for the feed roller and for the belt cradle adjustment mechanism.

The feed roller 20 is supported upon a coaxial feed roller shaft 27 which extends through corresponding apertures or bearings in the rear roller frame side walls 25 and 26 and also through corresponding bearings within the frame side walls 12 and 13. The journal bearings, not shown, are of such a structure as to permit the feed roller shaft 27 to be driven by a feed drive motor 28 and transmission 29 (FIG. 4), of any convenient construction, in order to drive the feed roller 20 and also to permit the rear roller frame 24 to pivot about the axis of the feed roller shaft 27.

Attached to the transverse rear frame member 30 are a pair of screwjack members 31, which are well known in the art. Each screwjack member 31 includes an elongated screw shaft, not shown, connected to the rear frame member 30 and hidden within the bellows cover 32. The screw shaft is threaded through a nut within a gear within the gear box 33, attached to the rear of the cloth roll support frame 11. The gears are driven by pinions within the gear boxes 33. The pinions, not shown, are formed on an elongated transverse driven shaft 34 which is reversibly rotated by a motor 60 through a reduction transmission 61. The motor 60 may be driven in one direction to lower the rear roller frame 24 to a horizontal position 24' (disclosed in phantom in FIG. 2), for loading the cloth roll 16, and may be reversed to move the rear roller frame 24 upward to positions such as the two solid-line positions disclosed in FIGS. 2 and 3.

The front feed belt member 17 includes a plurality of transversely spaced endless feed belts 35 trained about the front upper belt roller 36, the front intermediate belt roller 37 and around a lower belt roller, which may be portions of the feed roller 20, as best illustrated in FIG. 1-3.

The front upper belt roller 36 and the intermediate belt roller 37 are mounted on shafts 38 and 39, respectively, the ends of which are journaled in the side walls 41 and 42 of a front roller frame 40. The side frame walls or bars 41 and 42 are rigidly held in spaced apart relationship by the transverse strut or bar 43.

In order to support the front roller frame 40 within the cloth roll support frame 11, a pair of guide plates 44 are fixed upon the interior surface of each of the side walls 12 and 13. Each guide plate 44 is provided with an elongated upright guide slot 45, adjacent the rear of the guide plate 44. An elongated guide slot 46 is formed in the front portion of each of the guide plates 44, the longitudinal axis of the front guide slot 46 being substantially normal or perpendicular to the corresponding upright guide slot 45. Each pair of guide slots 45 and 46 are spaced apart a distance generally equalling the distance between the front and intermediate roller shafts 38 and 39.

The ends of the respective front and intermediate roll shafts 38 and 39 project through the corresponding side bars 41 and 42 of the front roller frame 40 and extend into the corresponding slots 46 and 45, respectively. The spacing and length of the slots 45 and 46 is such as to permit all of the front belt rollers 36, 37, and 20 to be substantially coplanar, while supporting the front endless belts 35 snugly to permit the transmission of rotary motion from the front rollers to the front feed belts 35 in order to feed a web 48 of cloth from the roll 16 forward. The web 45 may pass across an optional front guide roller 49, as disclosed in FIG. 2, if desired. In this initial or normal feed position for the front endless belts 35, as disclosed in FIG. 2, it will be seen that the front belt roll shaft 38 is located near the front end of its corresponding slots 46, while the intermediate roll shaft 39 is located near the bottom of its guide slots 45.

The guide slots 45 and 46 permit the front roller frame 40 to shift to the angular position disclosed in FIG. 3, in which the intermediate roller shaft 39 is near the top of its upright slots 45, while the front roller shaft 38 is near the rear end of its guide slots 46. In this second operative position disclosed in FIG. 3, the endless belts 35 have been thrust upward above the common plane of the axes of the upper roller shaft 38 and the lower feed roller shaft 27, with the front endless belts 35 being subject to the same tension as they are when the belts are in their normal aligned positions as disclosed in FIG. 2. Thus, the dimensions of the front roll frame 40 and the corresponding guide slots 45 and 46 permit the front rollers to compensate for the change in configuration of the front endless belts 35, as disclosed in FIG. 3, by permitting the front roller shaft 38 to be slightly retracted in its corresponding guide slots 46.

In order to lift the rear end portion of the front roller frame 40, or the front intermediate roller shaft 39, each end of the roller shaft 39 is fitted loosely with an annular collar 50, (FIGS. 1 and 2), each of which is attached by connectors 51 to one end of an elongated flexible member, such as the chain 52, which is trained about sprockets 53 and 54. The sprockets 54 are fixed to a transverse rotary lift shaft 55, which is driven through a chain transmission 56 and a gear reducer 57 by a lift motor 58, as disclosed in FIG. 4. As disclosed in FIG. 1, the collars 50 and chains 52 are provided on opposite sides of the front roller frame 40.

In the operation of a cloth feeder and support apparatus made in accordance with this invention, the front roller frame 40 is normally in its operative position disclosed in FIG. 2. The screwjack members 31 are actuated, by means, not shown, in order to lower the rear frame 24 to the phantom loading position 24' illustrated in FIG. 2. A large cloth roll 16 is then loaded manually, or with the assistance of a hoist, over the rear end of the rear roller frame 24 until the cloth roll 16 has its center of gravity approximately over the feed roller shaft 27. The jackscrew members 31 are then actuated to move upward until the rear belt feed member 18 is in its solid-line position disclosed in FIG. 2. The cloth spreading machine 10 is then operated to reciprocably move in a feeding direction longitudinal of the machine, back and forth over a cutting table, not shown, in a well known manner. As the cloth spreading machine 10 is moving over the cutting table, the cloth roll 16 is constantly unwinding, gradually diminishing in diameter.

When the cloth roll 16 is reduced to a predetermined diameter, a photoelectric sensor device 65 may be actuated to energize the lift motor 58 to cause the chains 52 to wind around the rotating lift shaft 55 to gradually elevate the front intermediate roller shaft 39 in its corresponding upright slots 45. The photoelectric sensor device 65 includes a light source for transmitting a beam of light across the machine to a reflector 66, and a light sensor for receiving the reflected beam. The beam of light is normally interrupted by the cloth roll 16, until it is unwound to a predetermined size. As the intermediate roller 37 is elevated, the lower top portion 63 of the front belt member 17 is thrust upwardly out of its normal path and is gradually elevated or pivoted about the rotary axis of the feed roller shaft 27, creating a smaller V-shaped angle in the roll support trough or cradle formed by the belt members 17 and 18, as best disclosed in FIG. 3.

Moreover, the screwjack members 31 may be actuated to further elevate the rear feed belt member 18, as illustrated in FIG. 3, to further reduce the angle in the V-shaped trough formed by the belt members 17 and 18.

By reducing the V-shaped angle, or increasing the depth of the trough, formed by the feed belt members 17 and 18, the smaller cloth roll, such as roll 16', will be engaged on both sides by steeper belt walls formed by the feed belt members 17 and 18 to prevent the smaller roll 16' of lesser weight from rocking back and forth and skewing, as it would on a more shallow belt cradle. As the diameter of the roll 16' diminishes, the roll tends to sink deeper into the V-shaped trough and become more snugly engaged by the steep belt walls, as illustrated by the even smaller roll 116 in FIG. 3. In fact, as disclosed in FIG. 3, the small roll 116 has its surfaces engaging the belts 19 and 35 below the intermediate rolls 37 and 22.

Thus, increasing the depth in the V-shaped trough formed by the decreasing angle between the feed belt members 17 and 18 by elevating the front intermediate belt roller 37 provides substantially greater control over the shrinking surface of a cloth roll 16, 16', 116, to stabilize the support of the cloth roll and the feeding of the web 48. The results of this improved control, particularly over smaller and lighter cloth rolls, substantially reduces wrinkling, misalignment, slack and excessive tension in the web spread upon the cutting table.

What is claimed is:

1. In a cloth spreading machine including a longitudinally movable machine frame, a cloth feed and support apparatus comprising:

(a) a cloth roll support frame having a longitudinal feed axis and opposite first and second ends, (b) a roll support cradle mounted in said roll support frame, (c) said cradle comprising first and second endless belt means extending longitudinally in a feed direction, said first and second belt means defining a substantially V-shaped trough and having lower adjacent end portions, said cradle being adapted to support a cloth roll extending transversely of said support frame and bearing on both said first and second belt feed means in an operative position, (d) first transverse roller means supporting said first belt means for rotary movement, (e) said first transverse roller means comprises upper and lower belt rollers having corresponding rotary axes, about which said first endless belt means is trained, (f) second transverse roller means supporting said second belt means for rotary movement, (g) means for driving at least one of said roller means for moving said belt means in said feeding direction, and (h) adjustment means cooperating with said cradle for positively moving said lower portion of one of said belt means toward and away from the lower portion of said other belt means in order to vary the angle of said V-shaped trough, and (i) said adjustment means further comprises a transverse intermediate roller between said upper and lower belt rollers and within said first endless belt means, and means for moving said intermediate roller toward and away from the common plane containing the rotary axes of said upper and lower rollers.

2. The invention according to claim 1 further comprising a first roller frame supporting said intermediate roller and said upper roller spaced apart from each other for free rotary movement within said first roller frame, intermediate guide means guiding said intermediate roller to move toward and away from said common plane, and second guide means guiding said upper belt roller to move toward and away from said lower belt roller, whereby when said intermediate roller is moved relative to said intermediate guide means, said upper belt roller will move commensurately to compensate for the movement of said first endless belt means.

3. The invention according to claim 2 in which said adjustment means further comprises actuator means for moving said intermediate roller relative to said first guide means away from said common plane to decrease the angle of said V-shaped trough.

4. The invention according to claim 3 in which said actuator means comprises a chain transmission having one end connected to said intermediate roller, and reversible motor means connected to the other end of said chain transmission for moving said intermediate roller.

5. The invention according to claim 3 in which said first guide means comprises a first guide slot in said cloth roll support frame, said intermediate roller having an elongated shaft, a portion of said shaft being received in said elongated first transverse guide slot, said second guide means comprising a second slot in said roll support frame extending longitudinally substantially normal to said first guide slot, said upper belt roller having an elongated shaft portion received in said second guide slot for longitudinal movement therein.

6. The invention according to claim 1 in which said second roller means comprises a second roller frame having a lower end and a plurality of second belt rollers guiding said second endless belt means and including a lower belt roller having a transverse pivotal axis about which said second roller frame is adapted to swing in a vertical plane, and second actuator means connecting to said second roller frame for positively moving said second roller frame up and down about said pivotal axis.

7. The invention according to claim 6 in which each of said first and second roller means comprises a common lower belt roll coaxial with said pivotal axis and about which both said first and second endless belt means are trained.

* * * * *